United States Patent [19]

Hochwitz

[11] 4,376,345

[45] Mar. 15, 1983

[54] FLEXIBLE SEAL FOR A PIVOT JOINT IN A SNOW THROWER CHUTE

[75] Inventor: Lynn E. Hochwitz, Sheboygan Falls, Wis.

[73] Assignee: Allis-Chalmers Corporation, Milwaukee, Wis.

[21] Appl. No.: 330,658

[22] Filed: Dec. 14, 1981

[51] Int. Cl.[3] ..... E01H 5/00

[52] U.S. Cl. ..... 37/260; 193/15; 285/223

[58] Field of Search ..... 37/260-262; 302/10, 59-63; 285/98, 184, 278, 223-224; 193/15

[56] References Cited

U.S. PATENT DOCUMENTS

| | | | |
|---|---|---|---|
| 514,266 | 2/1894 | Landis | 37/260 X |
| 2,494,659 | 1/1950 | Huyton | 285/224 X |
| 2,592,060 | 4/1952 | Oulianoff | 285/223 X |
| 2,750,235 | 6/1956 | Frushour | 37/260 X |
| 3,510,171 | 5/1970 | Bacon | 37/260 |
| 3,552,045 | 1/1971 | Fieber | 37/260 |
| 3,760,517 | 9/1973 | Blaauw | 37/260 |
| 3,780,455 | 12/1973 | Stevenson et al. | 37/261 |
| 3,828,450 | 8/1974 | Boeck | 37/260 |
| 3,867,773 | 2/1975 | Gunderson | 37/260 |
| 3,921,315 | 11/1975 | Tome | 37/260 |
| 3,968,576 | 10/1972 | Gillette | 37/261 |
| 4,205,468 | 6/1980 | Greider | 37/260 |

*Primary Examiner*—E. H. Eickholt

*Attorney, Agent, or Firm*—Charles L. Schwab

[57] ABSTRACT

A seal (41 or 141) is provided at the pivot joint between a deflector (19) and a snow chute (18) which has spaced fingers (42 or 142) permitting the leading edge of the seal (41 or 141) to conform to a reduced linear dimension when the deflector (19) is pivotal to a forward position of adjustment about its pivot axis (22).

5 Claims, 5 Drawing Figures

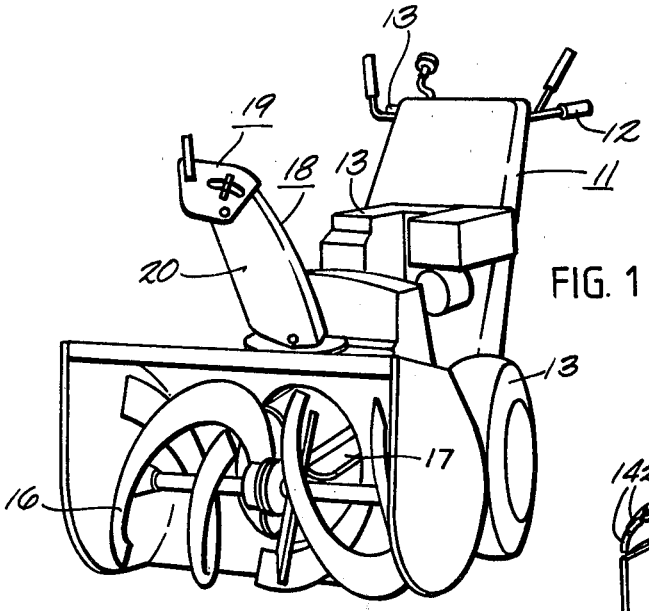
FIG. 1
FIG. 5
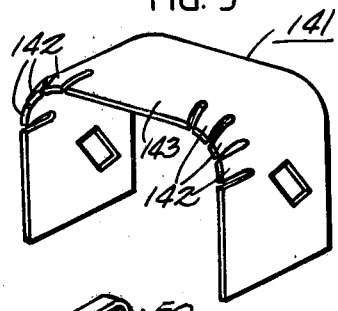
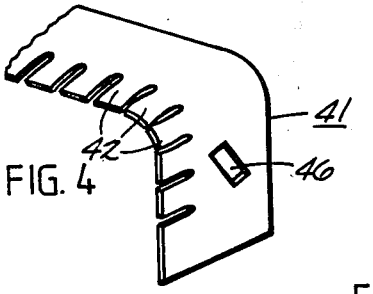
FIG. 4
FIG. 3
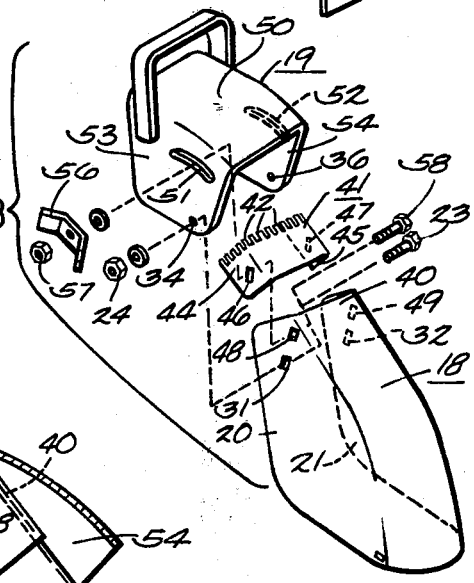
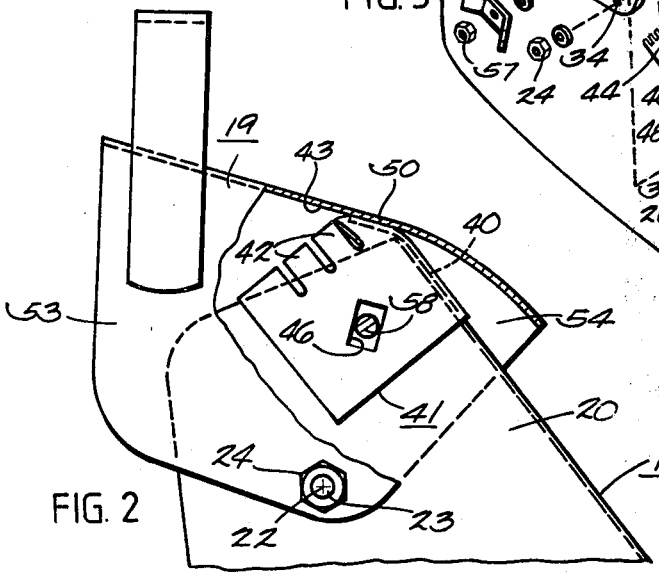
FIG. 2

FLEXIBLE SEAL FOR A PIVOT JOINT IN A SNOW THROWER CHUTE

BACKGROUND OF THE INVENTION

1. Technical Field

This invention relates to snow throwers and more particularly to the provision of sealing means between relatively movable parts of the snow discharge chute.

2. Prior Art

Heretofore others have provided snow thrower chutes with pivotable deflectors at their upper ends. For instance such construction is shown in U.S. Pat. Nos. 4,205,468; 3,867,773; 3,828,450; and 3,510,171. None of these patents, however, show the use of flexible sealing means at the pivot joint between a snow chute and a deflector pivotally connected to its upper end. In one prior art snow thrower, a flat piece of flexible material was interposed between a deflector and the upper end of the discharge chute to which it was pivotally connected; however, the flexible material did not properly conform to the shape of the deflector in its various pivotally adjusted positions and thus there was leakage of discharged snow at the joint.

It is a principal object of this invention to provide an improved seal for a pivot joint of a snow thrower discharge chute.

BRIEF DESCRIPTION OF THE INVENTION

In the present invention, a flexible seal is provided between the upper end of the snow thrower chute and the deflector pivoted thereto wherein a forward portion of the flexible seal extends upwardly and forwardly beyond the end of the top side of the chute and such forward portion is slotted so as to provide forwardly extending sealing fingers or tabs which bear against the underside of the deflector pivotally connected to the chute and individually flex as the deflector is moved so as to provide effective sealing against leakage of snow at the pivot joint.

BRIEF DESCRIPTION OF THE DRAWINGS

The invention is illustrated in the accompanying drawings, in which:

FIG. 1 is a pictorial view of a snow thrower in which the present invention is incorporated;

FIG. 2 is an enlarged side view of the upper part of the snow thrower chute and the deflector pivotally connected thereto with portions broken away for illustration purposes;

FIG. 3 is an exploded view of the snow thrower discharge chute, deflector, flexible seal, and fastening members;

FIG. 4 is a pictorial view of part of the seal showing it in a resiliently deflected condition; and FIG. 5 is a pictorial view of an alternate seal construction.

DETAILED DESCRIPTION OF THE INVENTION

As shown in FIG. 1, a walk behind snow thrower 11 is illustrated which has a pair of rearwardly projecting handles 12, 13 and an internal combustion engine 13 which drives a pair of ground engaging wheels 13, only one of which is shown, and auger and paddle wheel components 16, 17 through power trains not shown. The snow is thrown by the impeller 17 upwardly through a discharge chute 18 and is deflected by a deflector 19 which is pivotally connected to opposite sidewalls 20, 21 of the chute by suitable pivot type fastening means for pivotal movement about a horizontal axis 22.

As shown in FIGS. 2 and 3 the chute sidewalls 20, 21 present openings 31, 32 for receiving pivot members in the form of bolts 23 to which nuts 24 are secured. One bolt 23 and nut 24 are illustrated. The deflector 19 has a pair of aligned openings 34, 36 through which the bolts 23 extend to pivotally support the deflector 19 on the upper end of the discharge chute 18. A flexible, resilient plastic seal 41 of substantially uniform thickness is bonded or glued to the upper side of the top wall 40 and outer sides of the side walls 20, 21 of the snow discharge chute 18 so as to present a series of forwardly projecting fingers or sealing tabs 42 which sealing engage the underside surface 43 of the top wall 50 and the inside of side walls 53, 54 of the deflector 19. The downwardly extending sides 44, 45 of the flexible seal 41, which are glued to the laterally outer sides of the vertical side walls 20, 21, present a pair of aligned openings 46, 47 which align with openings 48, 49 in the discharge chute side walls 20, 21. The openings 48, 49 register with slots 51, 52 in the vertical side walls 53, 54 of the deflector when the deflector is installed on the chute 18. A releasable fastening means in the form of a wing nut 56 a lock nut 57 and bolt 58 releasably secure the side wall 53 of the deflector 19 in a position of pivotal adjustment about the axis 22 as may be selected within limits of the slot 51. A bolt, wing nut and lock nut, not shown, similarly connect the side wall 54 of the deflector to the side wall 21 of the chute 18 with the bolt extending through the opening 49 in the chute side wall 21, the opening 47 in the seal 41 and the slot 52 in the deflector side wall 54.

The forwardly projecting tabs or fingers 42 at spaced intervals across the front portion of the seal 41 will flexibly adjust to maintain sealing contact with the underside surface 43 of the deflector 19 within the range of pivotal adjustment of the deflector 19. When deflector 19 is pivoted forwardly about axis 22 to its illustrated position, at a midpoint in its range of pivotal adjustment, the resilient fingers or tabs 42 of the seal 41 contacting the underside surface 43 of the top wall 50 of the deflector will be bent downwardly. The slots between the tabs allow the tabs to move toward one another, as shown in FIG. 4, at the rounded corners where the side walls 53, 54 of the deflector join the top wall 50. The corners formed at the junction of the chute side walls 20, 21 and its top wall 40 are likewise rounded.

If the top walls 40, 50 of the chute and the deflector are substantially flat between the rounded corners, the alternate seal 141, shown in FIG. 5, may be effectively used in place of seal 41. Seal 141 is slotted at and adjacent to the corners to form three tabs or fingers 142 at each corner and a single wide tab 143 therebetween. The seals 41 and 141 as shown in FIGS. 4 and 5 are deflected in an installed condition with the deflector in the position of adjustment shown in FIGS. 1 and 2.

In deflectors having an arched top wall, I prefer to use the deflector 41 so as to avoid buckling of the front edge of the seal at the arched top wall when the deflector is adjusted forwardly deflecting the front portion of the seal downwardly, thereby forcing the front edge of the seal to occupy a reduced linear dimension. The flexible seal of this invention minimizes leakage of snow at the pivot joint between the deflector and discharge chute. Not only is the discharge of snow improved but there is less tendency of a freeze-up of the pivot joint since there is reduced presence of snow and slush between the walls of the deflector and the chute.

The embodiments of an invention in which an exclusive property or privilege is claimed are defined as follows:

1. In a snow thrower, the combination comprising:

a generally upright discharge chute presenting at its upper end a pair of generally upright side walls and an upwardly and forwardly inclined top wall interconnecting said side walls, a deflector having a top wall with a rear portion in overlying relation to the top wall of said chute and a pair of generally vertical side walls depending from opposite lateral sides of said top wall having portions in adjacent, overlapping relation to said side walls of said chute, a pair of pivot means pivotally interconnecting adjacent side walls of said deflector and chute for pivotal movement of said deflector relative to said chute about a generally horizontal axis, and a flexible seal of substantially uniform thickness interposed between said chute and deflector, said seal having rear top and side portions secured to the upper and laterally outer surfaces, respectively, of said top and side walls of said chute and having a front portion with a plurality of spaced, forwardly extending fingers in sealing engagement with the inside surface of said deflector.

2. The combination of claim 1 wherein said seal is made of a plastic material and is bonded to said chute.

3. The combination of claims 1 or 2 wherein the top walls of said chute and deflector are substantially flat and join the chute and deflector side walls to form rounded corners and wherein said seal presents said fingers at said corners.

4. The combination of claim 1 or 2 wherein said seal presents said fingers at spaced intervals across substantially said front portion.

5. The combination of claims 1 or 2 wherein said front portion of said seal is bent downwardly when said deflector is rotated forwardly about said horizontal axis thereby causing the leading edge of said front portion to occupy a reduced linear dimension.

* * * * *